US010692427B2

(12) United States Patent
Choi

(10) Patent No.: US 10,692,427 B2
(45) Date of Patent: Jun. 23, 2020

(54) PIXEL AND ORGANIC LIGHT EMITTING DISPLAY DEVICE USING THE PIXEL

(71) Applicant: SAMSUNG DISPLAY CO., LTD., Yongin-si, Gyeonggi-do (KR)

(72) Inventor: Sang-Moo Choi, Yongin-si (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 0 days.

(21) Appl. No.: 15/358,170

(22) Filed: Nov. 22, 2016

(65) Prior Publication Data

US 2017/0124950 A1 May 4, 2017

Related U.S. Application Data

(62) Division of application No. 13/137,497, filed on Aug. 22, 2011, now abandoned.

(30) Foreign Application Priority Data

Dec. 6, 2010 (KR) ..... 10-2010-0123438

(51) Int. Cl.
*G09G 3/3233* (2016.01)
*G09G 3/3266* (2016.01)
*G09G 3/3283* (2016.01)

(52) U.S. Cl.
CPC ..... *G09G 3/3233* (2013.01); *G09G 3/3266* (2013.01); *G09G 3/3283* (2013.01);
(Continued)

(58) Field of Classification Search
CPC ..... G09G 2300/0842; G09G 3/3233; G09G 3/3266; G09G 3/3283; G09G 2300/0866;
(Continued)

(56) References Cited

U.S. PATENT DOCUMENTS 7,646,363 B2 * 1/2010 Yamashita ..... G09G 3/3233 345/76
7,764,251 B2 * 7/2010 Yamashita ..... G09G 3/3233 315/169.1
(Continued)

FOREIGN PATENT DOCUMENTS

KR 10-2005-0005646 A 1/2005
KR 10-2005-0105534 A 11/2005
(Continued)

*Primary Examiner* — Jeff Piziali
(74) *Attorney, Agent, or Firm* — Kile Park Reed & Houtteman PLLC

(57) ABSTRACT

A pixel includes: an organic light emitting diode; a first transistor having a second electrode connected with an anode electrode of the organic light emitting diode and controlling the amount of current supplied to the organic light emitting diode; a second transistor connected between a data line and a second node and turned on when a scan signal is supplied to a scan line; a third transistor connected between a gate electrode and a second electrode of the first transistor and having a turn-on time partially overlapping the turn-on time of the second transistor; a fifth transistor connected between the second node and a power line receiving first power and having a turn-on time not overlapping the turn-on time of the second transistor; and a storage capacitor connected between a gate electrode of the first transistor and the second node.

10 Claims, 6 Drawing Sheets

(52) U.S. Cl.
CPC ..... *G09G 2300/043* (2013.01); *G09G 2300/0809* (2013.01); *G09G 2300/0842* (2013.01); *G09G 2300/0866* (2013.01); *G09G 2310/0262* (2013.01); *G09G 2320/045* (2013.01); *G09G 2320/0646* (2013.01)

(58) Field of Classification Search
CPC ..... G09G 2320/045; G09G 2310/0262; G09G 2300/043; G09G 2300/0809; G09G 2320/0646
See application file for complete search history.

(56) References Cited

U.S. PATENT DOCUMENTS 7,847,762 B2 12/2010 Iida et al.
7,876,293 B2 1/2011 Liu
8,013,812 B2 9/2011 Minami et al.
8,217,878 B2 7/2012 Yamashita et al.
8,319,706 B2 11/2012 Yamashita et al.
2004/0246241 A1* 12/2004 Sato ..... G09G 3/325 345/204
2005/0012686 A1* 1/2005 Osame ..... H01L 51/52 345/39
2005/0083270 A1* 4/2005 Miyazawa ..... G09G 3/3233 345/76
2005/0206590 A1* 9/2005 Sasaki ..... G09G 3/3233 345/76
2005/0269959 A1* 12/2005 Uchino ..... G09G 3/2011 315/169.3
2006/0123293 A1* 6/2006 Kim ..... G09G 3/3291 714/724
2006/0232574 A1* 10/2006 Miyazawa ..... G09G 3/3233 345/204
2006/0261864 A1* 11/2006 Miyazawa ..... G09G 3/325 327/112
2006/0262048 A1* 11/2006 Yamada ..... B60K 35/00 345/76
2007/0115225 A1* 5/2007 Uchino ..... G09G 3/3233 345/76
2009/0225013 A1* 9/2009 Lee ..... G09G 3/3233 345/80
2010/0039356 A1 2/2010 Kimura
2010/0156762 A1 6/2010 Choi
2011/0025671 A1 2/2011 Lee
2012/0019500 A1 1/2012 Hwang et al.
2012/0139957 A1 6/2012 Choi

FOREIGN PATENT DOCUMENTS

KR 10-2007-0083072 A 8/2007
KR 10-2008-0091926 A 10/2008
KR 10-2010-0071301 A 6/2010
KR 10-2010-0098860 A 9/2010
KR 10-2011-0013693 A 2/2011
KR 10-2012-0009671 A 2/2012
KR 10-2012-0062251 A 6/2012

* cited by examiner

PIXEL AND ORGANIC LIGHT EMITTING DISPLAY DEVICE USING THE PIXEL

CROSS REFERENCE TO RELATED APPLICATION

This is a divisional application based on pending application Ser. No. 13/137,497, filed Aug. 22, 2011, the entire contents of which is hereby incorporated by reference.

BACKGROUND

1. Field

The present embodiments relate to a pixel and an organic light emitting display device utilizing the pixel. More particularly, the pixel can display an image having uniform luminance, regardless of the threshold voltage of a driving transistor.

2. Description of the Related Art

Recently, a variety of flat panel displays have been developed that make it possible to reduce the weight and volume of cathode ray tubes. Typical flat panel displays may be a liquid crystal display, a field emission display, a plasma display panel, an organic light emitting display device, etc.

The organic light emitting display device displays an image by using an organic light emitting diode. The organic light emitting diode produces light by recombining an electrode and a hole. The organic light emitting display device has the advantage of high response speed and low power.

SUMMARY

Therefore, the present embodiments provide a pixel.

A pixel according to the present embodiments may include: an organic light emitting diode; a first transistor having a second electrode connected with an anode electrode of the organic light emitting diode, the first transistor controlling the amount of current supplied to the organic light emitting diode; a second transistor connected between a data line and a second node, the second transistor turned on when a scan signal is supplied to a scan line; a third transistor connected between a gate electrode and a second electrode of the first transistor, the third transistor having a turn-on time partially overlapping the turn-on time of the second transistor; a fifth transistor connected between the second node and a power line receiving first power, the fifth transistor having a turn-on time not overlapping the turn-on time of the second transistor; and a storage capacitor connected between a gate electrode of the first transistor and the second node.

The pixel may further include a fourth transistor connected between the second node and a first electrode of the first transistor, the fourth transistor turned on and off simultaneously with the fifth transistor. The pixel may further include a fourth transistor connected between a second electrode of the first transistor and the third transistor, the fourth transistor turned on and off simultaneously with the fifth transistor. The pixel may further include a capacitor connected between an anode electrode of the organic light emitting diode and a fixed power supply.

An organic light emitting display device according to the present embodiments may include: a plurality of pixels connected with scan lines, control lines, emission control lines, power lines, and data lines; a scan driver driving the scan lines, the emission control lines, and control lines; a first power driver sequentially supplying a first power, the first power changes to an initial voltage, a reference voltage, higher than the initial voltage, and a high voltage, higher than the reference voltage, the initial voltage, the reference voltage, and the high voltage supplied to the power lines; and a data driver supplying data signals to the data lines.

The scan driver may supply a scan signal to the i-th scan line, when the high voltage is supplied to the i-th power line (i is a natural number). The scan driver may supply a control signal to the i-th control line to overlap the scan signal supplied to the i-th scan line and the reference voltage supplied to the i-th power line. The scan driver may supply an emission control signal to the i-th emission control line to overlap the scan signal supplied to the i-th scan line. The initial voltage may be a voltage where the pixels are set in a non-emission state.

An organic light emitting display device according to the present embodiments may include: a plurality of pixels connected with scan lines, emission control lines, power lines, and data lines; a scan driver driving the scan lines and the emission control lines; a first power driver sequentially supplying a first power, the first power changes to an initial voltage, a reference voltage, higher than the initial voltage, and a high voltage, higher than the reference voltage, the initial voltage, the reference voltage, and the high voltage supplied to the power line; and a data driver supplying data signals to the data lines, in which the scan driver supplies a scan signal to the i+1-th scan line to overlap the scan signal supplied to the i-th scan line at least for one horizontal period 1H (i is a natural number).

BRIEF DESCRIPTION OF THE DRAWINGS

The accompanying drawings, together with the specification, illustrate exemplary embodiments, and, together with the description, serve to explain the principles of the inventive concept.

DETAILED DESCRIPTION

Korean Patent Application No. 10-2010-0123438, filed on Dec. 6, 2010, in the Korean Intellectual Property Office, and entitled: "Pixel and Organic Light Emitting Display Device Using the Pixel" is incorporated by reference herein in its entirety.

The inventive concept will now be described more fully hereinafter with reference to the accompanying drawings, in which exemplary embodiments of the inventive concept are illustrated. The inventive concept, may, however, be embodied in different forms and should not be construed as limited to the embodiments set forth herein. Rather, these embodiments are provided so that this disclosure will be thorough and complete, and will fully convey the scope of the inventive concept to those skilled in the art.

Preferred embodiments for those skilled in the art are described hereafter in detail with reference to FIGS. 1 to 8.

Figure 1:
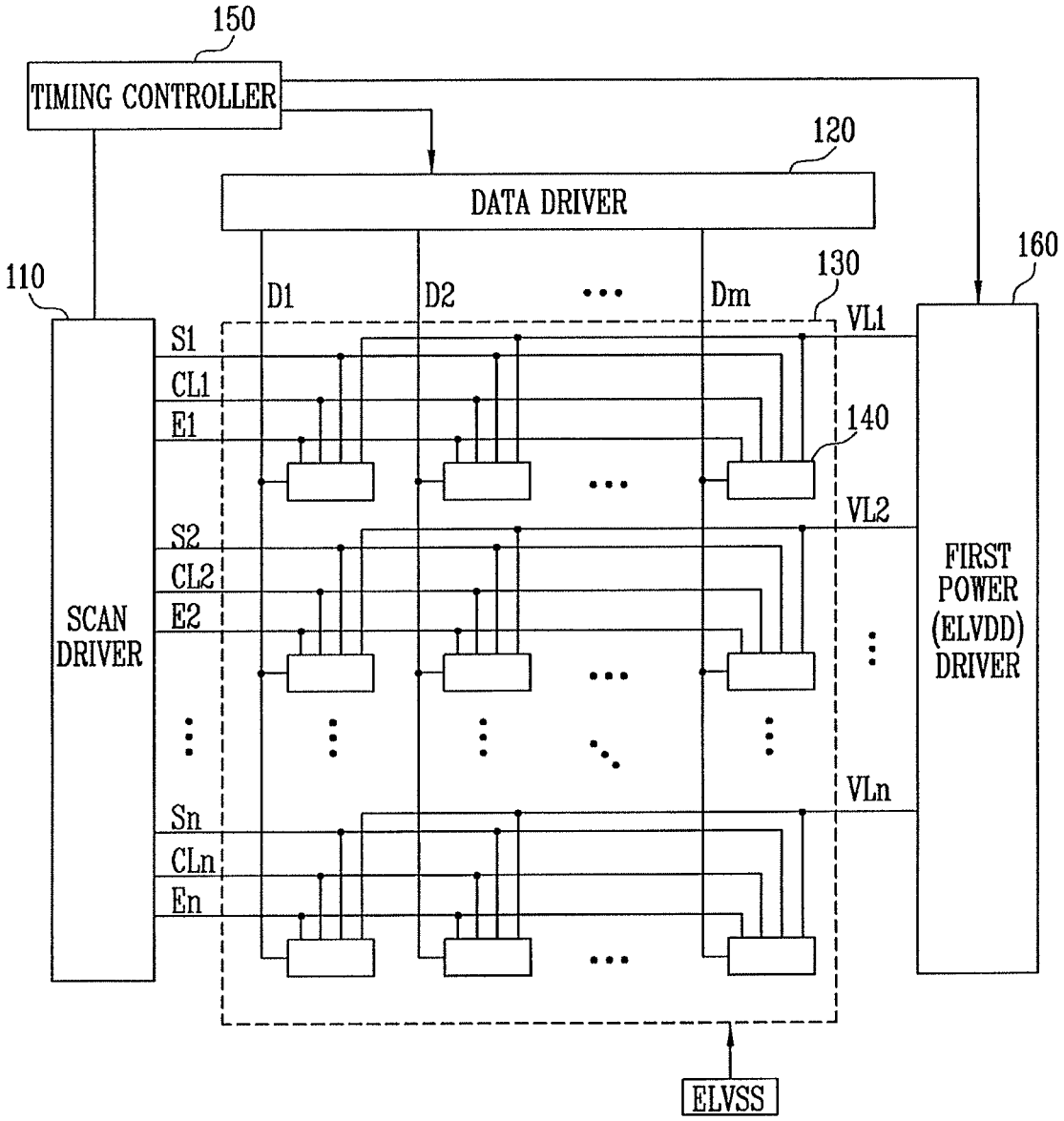
FIG. 1 is a diagram illustrating an organic light emitting display device according to an embodiment.

FIG. 1 is a diagram illustrating an organic light emitting display device according to an embodiment.

Referring to FIG. 1, an organic light emitting display device according to an embodiment includes: a pixel unit 130 including pixels 140 disposed at the intersections of scan lines S1 to Sn and data lines D1 to Dm, a scan driver 110 that drives the scan lines S1 to Sn, control lines CL1 to CLn, and emission control lines E1 to En, a data driver 120 that drives the data lines D1 to Dm, a first power driver 160 that drives power lines VL1 to VLn, and a timing controller 150 that controls the drivers 110, 120, and 160.

The first power driver 160 supplies a first voltage ELVDD to the power lines VL1 to VLn. The first voltage ELVDD changes to an initial voltage Vint, a reference voltage Vref, and a high voltage Vhigh.

Figure 3:
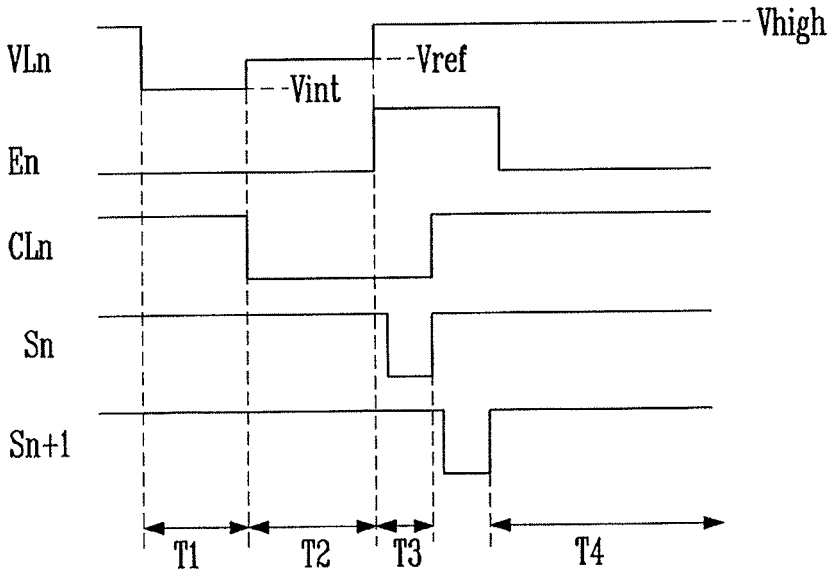
FIG. 3 is a waveform diagram illustrating a method of driving the pixel shown in FIG. 2.

As shown in FIG. 3, the first power driver 160 supplies the initial voltage Vint, the reference voltage Vref, higher than the initial voltage Vint, and the high voltage Vhigh, higher than the reference voltage Vref to the power line VLn. In this configuration, the high voltage Vhigh, supplied to the n-th power line VLn, is set to overlap the scan line supplied to the n-th scan line Sn. The initial voltage Vint is set at sufficiently low voltage such that the organic light emitting diode (OLED) is set in a non-emission state. The high voltage Vhigh is set at sufficiently high voltage such that the organic light emitting diode (OLED) is set in an emission state.

The scan driver 110 sequentially supplies scan signals to the scan lines S1 to Sn. The scan driver 110 sequentially supplies emission control signals to the emission control lines E1 to En. The scan driver 110 sequentially supplies control signals to the control lines CL1 to CLn.

The scan driver 110 supplies an emission control signal to the i-th emission control line Ei to overlap the scan signal supplied to the i-th second scan line Si (i is a natural number). The scan driver 110 supplies a control signal to the i-th control line CLi to overlap the reference voltage Vref supplied to the i-th power line VLi and the scan signal supplied to the i-th scan line Si.

Although FIG. 1 shows the scan lines S1 to Sn, the emission control lines E1 to En, and control lines CL1 to CLn are connected to the scan driver, the present embodiments are not limited thereto. For example, the emission control lines E1 to En and the control lines CL1 to CLn may be connected drivers (not shown).

The data driver 120 supplies data signals to the data lines D1 to Dm in synchronization with the scan signals supplied to the scan lines S1 to Sn.

The timing control unit 150 controls the scan driver 110, the data driver 120, and the first power driver 160, in response to synchronization signals supplied from the outside.

When the initial voltage Vint is supplied to the first power supply ELVDD, the pixel 140 initializes the anode electrode of the organic light emitting diode OLED to the initial voltage Vint. When the reference voltage Vref is supplied, the pixel 140 compensates the threshold voltage of the driving transistor. When the high voltage Vhigh is supplied to the first power supply ELVDD, the pixel 140 produces light with predetermined luminance while being charged with voltage correspond to a data signal and supplying current corresponding to the stored voltage to the organic light emitting diode (OLED).

Figure 2:
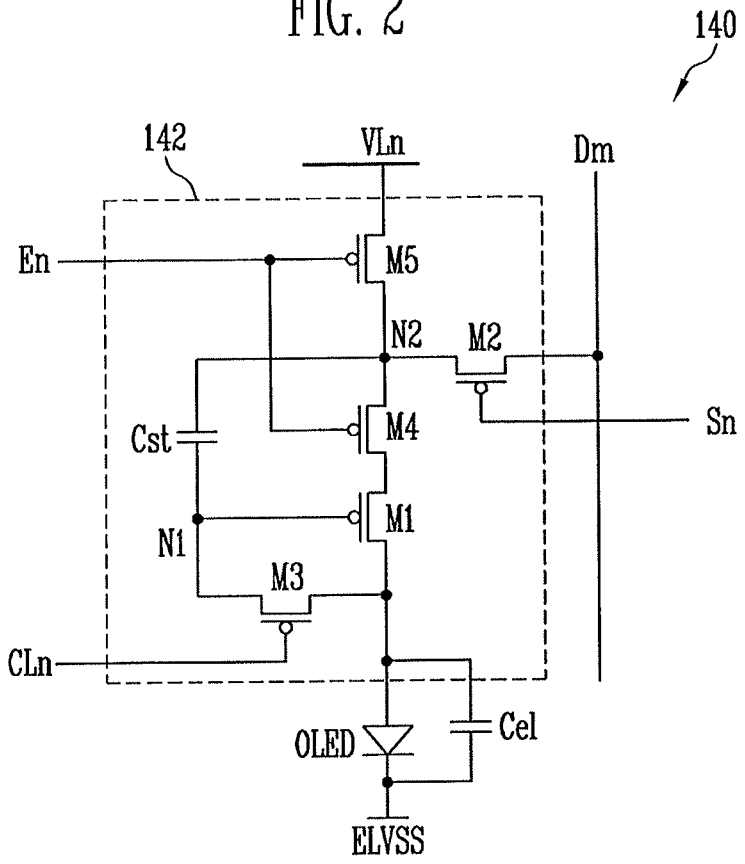
FIG. 2 is a diagram illustrating a pixel according to a first embodiment.

FIG. 2 is a diagram illustrating a pixel according to a first embodiment. The pixel connected with the n-th scan line Sn and the m-th data line Dm is shown in FIG. 2.

Referring to FIG. 2, the pixel 140, according to an embodiment, includes: an organic light emitting diode (OLED) and a pixel circuit 142 connected to the data line Dm and the scan line Sn. The pixel circuit 142 controls and the amount of current supplied to the organic light emitting diode (OLED).

The anode electrode of the organic light emitting diode (OLED) is connected to the pixel circuit 142. The cathode electrode is connected to a second power supply ELVSS. The organic light emitting diode (OLED) produces light with predetermined luminance in response to the amount of current supplied from the pixel circuit.

The pixel circuit 142 receives a data signal through the data line Dm when a scan signal is supplied to the scan line Sn. The pixel circuit 142 controls the current flowing from the first power supply ELVDD at the high voltage Vhigh to the second power supply ELVSS through the organic light emitting diode (OLED) in response to the received data signal. For this operation, the pixel circuit 142 includes first to fifth transistors M1 to M5 and a storage capacitor Cst.

The storage capacitor Cst is connected between a first node N1 and a second node N2. The storage capacitor Cst is charged with a voltage corresponding to a data signal and the threshold voltage of the first transistor M1 (driving transistor).

A first electrode of the first transistor M1 is connected to a second electrode of the fourth transistor M4. A second electrode is connected to the anode electrode of the organic light emitting diode (OLED). A gate electrode of the first transistor M1 is connected to the first node N1. The first transistor M1 controls the amount of current supplied to the organic light emitting diode (OLED) in response to the voltage applied to the first node N1.

A first electrode of the second transistor M2 is connected to the data line Dm. A second electrode is connected to the second node N2. A gate electrode of the second transistor M2 is connected to the scan line Sn. When the scan signal is supplied to the scan line Sn, the second transistor M2 is turned on and electrically connects the data line Dm with the second node N2.

A first electrode of the third transistor M3 is connected to a second electrode of the first transistor M1. A second electrode is connected to the first node N1. A gate electrode of the third transistor M3 is connected to a control line CLn. When a scan signal is supplied to the control line CLn, the third transistor M3 is turned on and connects the first transistor M1 in a diode type.

A first electrode of the fourth transistor M4 is connected to the second node N2. The second electrode is connected to the first electrode of the first transistor M1. A gate electrode of the fourth transistor M4 is connected to the emission control line En. When an emission control signal is supplied to the emission control line En, the fourth transistor M4 is turned off. When an emission control signal is not supplied, the fourth transistor M4 is turned on.

A first electrode of the fifth transistor M5 is connected to the power line VLn and a second electrode is connected to the second node N2. The gate electrode of the fifth transistor M5 is connected to an emission control line En. When an emission control signal is supplied to the emission control line En, the fifth transistor M5 is turned off. When an emission control signal is not supplied, the fifth transistor M5 is turned on.

The capacitor Cel shown in FIG. 2 implies a parasitic capacitor of the organic light emitting diode (OLED). The parasitic capacitor Cel has a larger capacitance than the storage capacitor Cst.

FIG. 3 is a waveform diagram illustrating a method of driving the pixel shown in FIG. 2. FIG. 3 additionally shows a scan signal that is supplied to a virtual n+1-th scan line Sn+1 to clearly show the supply characteristics of the waveforms.

Referring to FIG. 3, the initial voltage Vint is supplied to the power line VLn for a first period T1. In this process, since the fourth transistor M4 and the fifth transistor M5 stay turned on for the first period T1, the anode electrode of the organic light emitting diode (OLED) drops to the initial voltage Vint. The parasitic capacitor Cel is charged with the initial voltage Vint.

While a control signal is supplied to the control line CLn, for a second period T2, the reference voltage Vref is supplied to the power line VLn.

As the control signal is supplied to the control line CLn, the third transistor M3 is turned on. The first node N1 and the anode electrode of the organic light emitting diode (OLED) are electrically connected. The voltage of the first node N1 drops approximately to the initial voltage Vint, corresponding to the voltage stored in the parasitic capacitor Cel.

The reference voltage Vref supplied to the power line VLn is supplied to the first electrode of the first transistor M1. Accordingly, the voltage of the first node N1 increases from the initial voltage Vint up to voltage Vref−|Vth|. Voltage Vref−|Vth| is obtained by subtracting the threshold voltage of the first transistor from the reference voltage Vref.

Thereafter, the high voltage Vhigh is supplied to the power line VLn. A scan signal is supplied to the scan line Sn in the third period T3. An emission control signal is supplied to the emission control line En for the third period T3.

As the emission control signal is supplied to the emission control line En, the fourth transistor M4 and the fifth transistor M5 are turned off. As the fourth transistor M4 is turned off, the second node N2 and the first transistor M1 are electrically disconnected. When the fifth transistor M5 is turned off, the power line VLn and the second node N2 are electrically disconnected.

As the scan signal is supplied to the scan line Sn, the second transistor M2 is turned on. When the second transistor M2 is turned on, the second node N2 and the data line Dm are electrically connected. In this state, a data signal from the data line Dm is supplied to the second node N2. Accordingly, the voltage of the second node N2 changes from the reference voltage Vref to the voltage of the data signal.

The storage capacitor Cst is charged with a voltage expressed by Formula 1 below:

$$Cst(V) = \frac{Cst}{(Cst + Cel)} \times (Vdata - Vref) + Vref - |Vth| \quad \text{[Formula 1]}$$

In Formula 1, CSt(V) is a voltage changed in the storage capacitor Cst and Vdata is a voltage of a data signal. Vth is the threshold voltage of the first transistor M1.

After the storage capacitor Cst is charged with the voltage expressed in Formula 1, an emission control signal stops being supplied to the emission control line En in the fourth period T4. As the supply of the emission control signal to the emission control line En is stopped, the fourth transistor M4 and the fifth transistor M5 are turned on.

As the fourth transistor M4 is turned on, the high voltage Vhigh is supplied to the second node N2. In this state, since the first node N1 is set in a floating state, the storage capacitor Cst keeps the voltage stored for the third period T3. The high voltage is supplied to the first electrode of the first transistor M1, when the fifth transistor M5 is turned on. In response to the voltage stored in the storage capacitor Cst, the first transistor M1 controls the amount of current flowing from the high voltage Vhigh to the second power supply ELVSS through the organic light emitting diode (OLED).

The present embodiments have the advantage of being able to compensate the threshold voltage of the driving transistor M1. The pixel circuit 142 includes five transistors M1 to M5 and one capacitor Cst.

According to the present embodiment, it is possible to remove image non-uniformity. Image non-uniformity is removed because an off-bias voltage is applied to the first transistor M1 for the first period T1. When an off-bias voltage is not applied to the first transistor M1, luminance increases in a staircase waveform, as the white gradation is implemented from black. However, it is possible in the present embodiments, to display an image with desired luminance without luminance non-uniformity by applying an off-bias voltage to the first transistor M1 for the first period T1.

As expressed by Formula 1, regardless of the first power ELVDD, the voltage is stored in the storage capacitor Cst. Thus, in the present embodiments, it is possible to display an image with desired luminance, regardless of the voltage drop of the first power supply ELVDD. By controlling the second period T2 where the control signal and the reference voltage Vref are supplied, the present embodiments also have the advantage of being able to compensate the threshold voltage of the first transistor M1 for a sufficient time.

Figure 4:
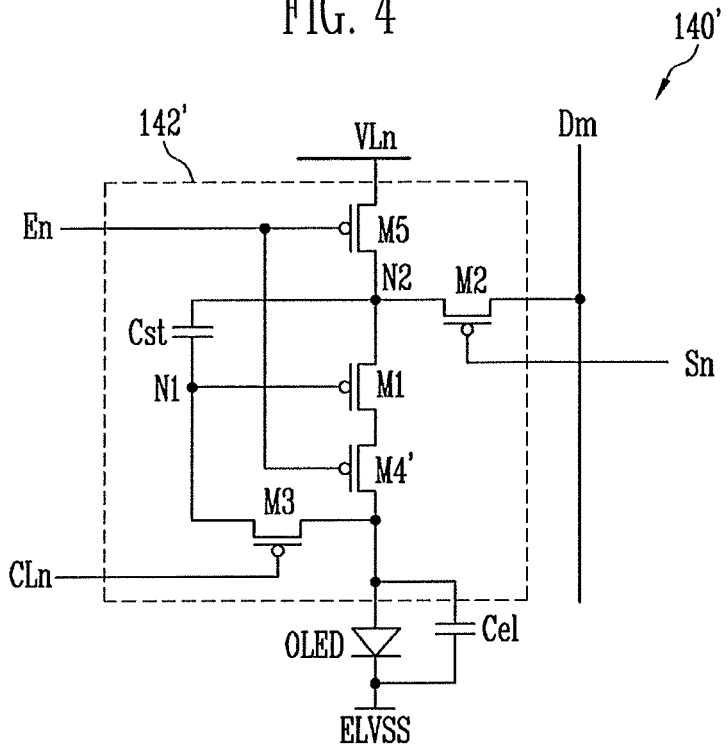
FIG. 4 is a diagram illustrating a pixel according to a second embodiment.

According to a second embodiment, FIG. 4 is a diagram illustrating a pixel. In describing FIG. 4, the same components as in FIG. 2 are designated by the same reference numerals. Thus, the detailed description is not provided.

According to the second embodiment and referring to FIG. 4, a fourth transistor M4' in a pixel circuit 142' of the present invention is connected between the first transistor M1 and the third transistor M3. A first electrode of the fourth transistor M4' is connected to the second electrode of the first transistor M1. A second electrode is connected to the first electrode of the third transistor M3. A gate electrode of the fourth transistor M4' is connected to the emission control line En. When an emission control signal is supplied to the emission control line En, the fourth transistor M4' is turned off. In the other cases, the fourth transistor M4' is turned on and controls the connection between the first transistor M1 and the third transistor M3.

With the exception that the position of the fourth transistor M4' changes, the pixel, according to the second embodiment, has the same operation as the pixel of the first embodiment shown in FIG. 2. Therefore, the detailed description is not provided.

Figure 5:
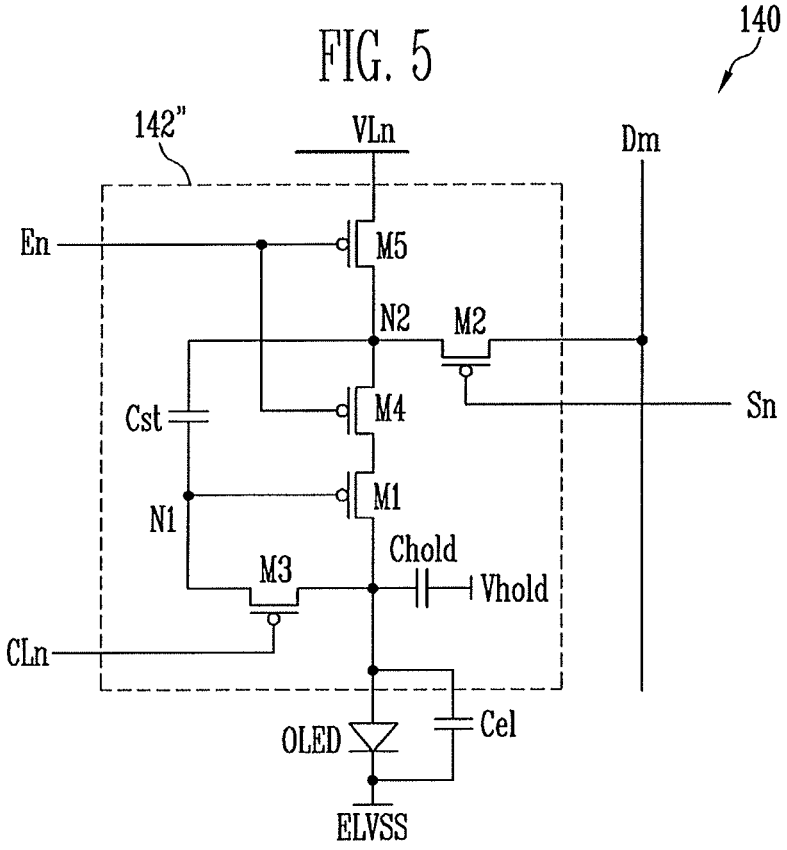
FIG. 5 is a diagram illustrating a pixel according to a third embodiment.

FIG. 5 is a diagram illustrating a pixel according to a third embodiment. In describing FIG. 5, the same components as in FIG. 2 are designated by the same reference numerals. Thus, the detailed description is not provided.

Referring to FIG. 5, a pixel circuit 142", according to the third embodiment additionally includes a capacitor Chold connected between the anode electrode of an organic light emitting diode (OLED) and a fixed power supply Vhold.

As expressed in Formula 1, the voltage stored in the storage capacitor Cst is influenced by the storage capacitor Cst and the parasitic capacitor Cel. In this configuration, the storage capacitor Cst and the parasitic capacitor Cel is provided with predetermined capacitance. Therefore, in the third embodiment, it is possible to control the voltage range of a data signal by forming and controlling the capacitance of the capacitor Chold. The power supply Vhold has a fixed voltage (i.e. a DC voltage). The fixed voltage may be any one of a variety of voltages supplied to a panel.

Figure 6:
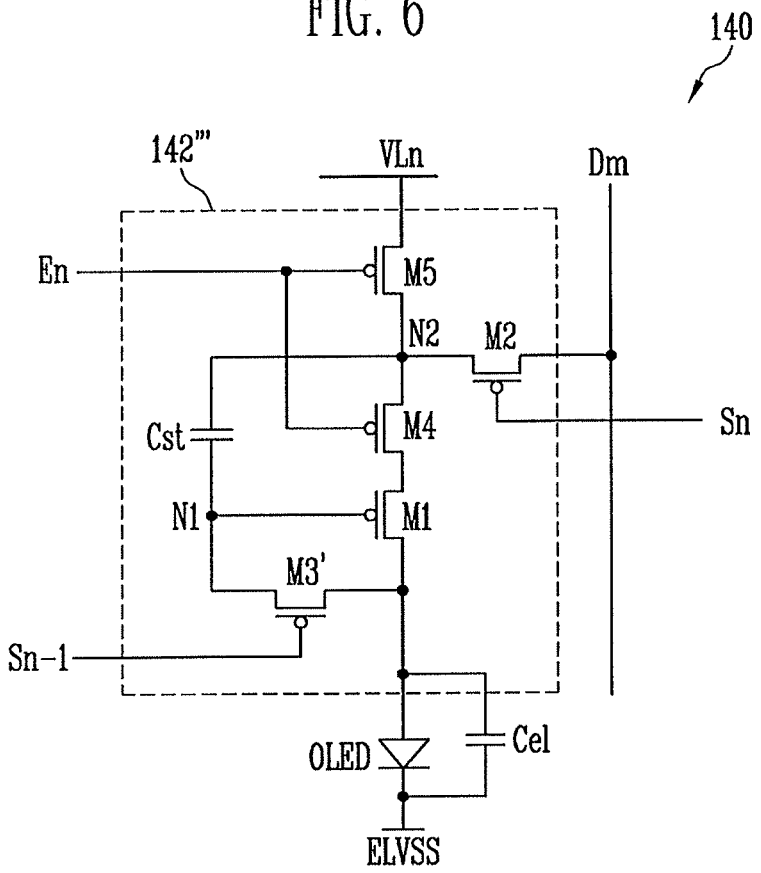
FIG. 6 is a diagram illustrating a pixel according to a fourth embodiment.

FIG. 6 is a diagram illustrating a pixel according to a fourth embodiment. In explaining FIG. 6, the same components as in FIG. 2 are designated by the same reference numerals. Thus, the detailed description is not provided.

Referring to FIG. 6, a gate electrode of a third transistor M3', in a pixel circuit 142''' according to a fourth embodiment, is connected to the n−1-th scan line Sn−1. When a scan signal is supplied to the n−1-th scan line Sn−1, the third transistor M3' is turned on. The third transistor M3' is turned off in the other cases In comparison to the pixel circuit 142 shown in FIG. 2, the third transistor M3 is connected with the control line CLn in FIG. 2. In this scenario, it is possible to freely set the time when the third transistor M3 is turned on. Accordingly, it is possible to ensure the time for compensating the threshold voltage of the first transistor M1. However, in this scenario, it may be a burden to add a specific line (i.e. a control line).

According to the fourth embodiment, the third transistor M3' is connected with the n−1-th scan line Sn−1 in a pixel circuit 142'. In this scenario, the time when the third transistor M3' is turned on is limited by the width of a scan signal. However, a specific line is not required. Since the third transistor M3' is connected with the n−1-th scan line Sn−1, the scan signal supplied to the n−1-th scan line Sn−1 and the scan signal supplied to the n-th scan line Sn overlap each other at least for the one horizontal period 1H.

Figure 7:
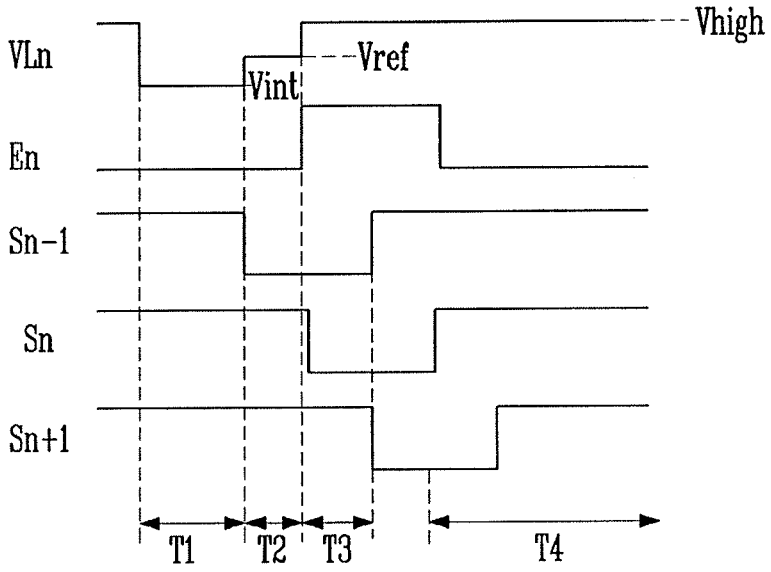
FIG. 7 is a waveform diagram illustrating a driving method according to a first embodiment of the pixel shown in FIG. 6.

FIG. 7 is a waveform diagram illustrating a driving method, according to a first embodiment of the pixel, shown in FIG. 6. Assume that in FIG. 7, the scan signal supplied to the n−1-th scan line Sn−1 and the scan signal supplied to the n-th scan line Sn overlap each other for one horizontal period 1H. Thus, the emission control signal supplied to the n-th emission control line En is supplied, and overlaps the scan signal supplied to the n-th scan line Sn.

Referring to FIG. 7, the initial voltage Vint is supplied to the power line VLn for a first period T1. Since the fourth transistor M4 and the fifth transistor M5 stays turned on for the first period T1, the anode electrode of the organic light emitting diode (OLED) drops to the initial voltage Vint. The parasitic capacitor Cel is charged with the initial voltage Vint.

While a scan signal is supplied to the n−1-th scan line Sn−1 during the second period T2, the reference voltage Vref is supplied to the power line VLn. As the scan signal is supplied to the n−1-th scan line Sn−1, the third transistor M3 is turned on. The first node N1 and the anode electrode of the organic light emitting diode (OLED) are electrically connected. In this state, the voltage of the first node N1 drops approximately to the initial voltage Vint, corresponding to the voltage stored in the parasitic capacitor Cel.

The reference voltage Vref, supplied to the power line VLn, is supplied to the first electrode of the first transistor M1. Accordingly, the voltage of the first node N1 increases from the initial voltage Vint up to the voltage Vref−|Vth|. The voltage Vref−|Vth| is obtained by subtracting the threshold voltage of the first transistor from the reference voltage Vref. The second period T2, in which the threshold voltage of the first transistor M1 is compensated, is set from when a scan signal is supplied to the n−1-th scan line Sn−1 until the scan signal is supplied to the n-th scan line Sn.

For the third period T3, the high voltage Vhigh is supplied to the power line VLn and a scan signal is supplied to the n-th scan line Sn. An emission control signal is supplied to the emission control line En for the third period T3.

As the emission control signal is supplied to the emission control line En, the fourth transistor M4 and the fifth transistor M5 are turned off. As the fourth transistor M4 is turned off, the second node N2 and the first transistor M1 are electrically disconnected. When the fifth transistor M5 is turned off, the power line VLn and the second node N2 are electrically disconnected.

As the scan signal is supplied to the n-th scan line Sn, the second transistor M2 is turned on. When the second transistor M2 is turned on, the second node N2 and the data line Dm are electrically connected. In this state, a data signal from the data line Dm is supplied to the second node N2. Accordingly, the voltage of the second node N2 changes from the reference voltage Vref to the voltage of the data signal. The storage capacitor Cst is charged with voltage expressed by Formula 1.

After the storage capacitor Cst is charged with the voltage expressed in Formula 1, an emission control signal stops being supplied to the emission control line En in the fourth period T4. As the supply of the emission control signal to the emission control line En is stopped, the fourth transistor M4 and the fifth transistor M5 are turned on.

As the fourth transistor M4 is turned on, the high voltage Vhigh is supplied to the second node N2. In this state, since the first node N1 is set in a floating state, the storage capacitor Cst keeps the voltage stored for the third period T3. When the fifth transistor M5 is turned on, the high voltage is supplied to the first electrode of the first transistor M1. In this process, in response to the voltage stored in the storage capacitor Cst, the first transistor M1 controls the amount of current flowing from the high voltage Vhigh to the second power supply ELVSS through the organic light emitting diode (OLED).

Figure 8:
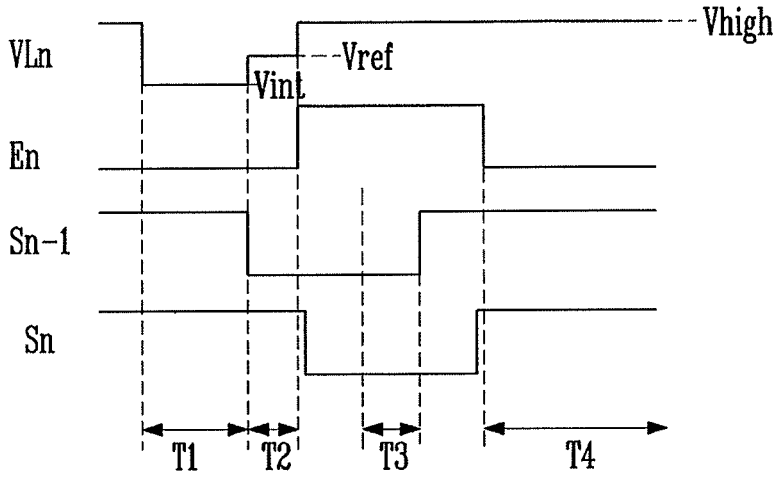
FIG. 8 is a waveform diagram illustrating a driving method according to a second embodiment of the pixel shown in FIG. 6.

According to a second embodiment of the pixel shown in FIG. 6, FIG. 8 is a waveform diagram illustrating a driving method. Assume in FIG. 8 that the scan signal supplied to the n−1-th scan line Sn−1 and the scan signal supplied to the n-th scan line Sn overlap each other for two horizontal periods 2H. In this configuration, the emission control signal supplied to the n-th emission control line En is supplied, and overlaps the scan signal supplied to the n-th scan line Sn.

For the first period T1 and referring to FIG. 8, as the initial voltage Vint is supplied first to the power line VLn, the anode electrode of the organic light emitting diode (OLED) drops to the initial voltage Vint. The parasitic capacitor Cel is charged with the initial voltage Vint.

While a scan signal is supplied to the n−1-th scan line Sn−1, for the second period T2, the reference voltage Vref is supplied to the power line VLn. As the scan signal is supplied to the n−1-th scan line Sn−1, the third transistor M3' is turned on and the first node N1 and the anode electrode of the organic light emitting diode (OLED) are electrically connected. Thus, the voltage of the first node N1 drops approximately to the initial voltage Vint, corresponding to the voltage stored in the parasitic capacitor Cel.

The reference voltage Vref, supplied to the power line VLn, is supplied to the first electrode of the first transistor M1. Accordingly, the voltage of the first node N1 increases from the initial voltage Vint up to the voltage Vref−|Vth|. The voltage Vref−|Vth| is obtained by subtracting the threshold voltage of the first transistor from the reference voltage Vref.

For the third period T3, the high voltage Vhigh is supplied to the power line VLn and a scan signal is supplied to the n-th scan line Sn. An emission control signal is supplied to the emission control line En for the third period T3.

As the emission control signal is supplied to the emission control line En, the fourth transistor M4 and the fifth transistor M5 are turned off. As the fourth transistor M4 is turned off, the second node N2 and the first transistor M1 are electrically disconnected. When the fifth transistor M5 is turned off, the power line VLn and the second node N2 are electrically disconnected.

As the scan signal is supplied to the n-th scan line Sn, the second transistor M2 is turned on. When the second transistor M2 is turned on, the second node N2 and the data line Dm are electrically connected. In this state, a data signal from the data line Dm is supplied to the second node N2. Accordingly, the voltage of the second node N2 changes from the reference voltage Vref to the voltage of the data signal. Therefore, the storage capacitor Cst is charged with voltage expressed by Formula 1.

When the previous scan signal and the present scan signal overlap each other for two horizontal periods 2H, it is possible to ensure more charge time of a data signal. The charge time of a data signal is reduced by the falling time of the n-th scan signal Sn, as shown in the waveform diagram of FIG. 7. In the waveform diagram of FIG. 8, the charge time of a data signal is determined, regardless of the falling time of the n-th scan signal Sn, so that it is possible to ensure more charge time.

After the storage capacitor Cst is charged with the voltage expressed in Formula 1, in the fourth period T4, an emission control signal will stop being supplied to the emission control line En. As the supply of the emission control signal to the emission control line En is stopped, the fourth transistor M4 and the fifth transistor M5 are turned on.

As the fourth transistor M4 is turned on, the high voltage Vhigh is supplied to the second node N2. In this state, since the first node N1 is set in a floating state, the storage capacitor Cst keeps the voltage stored for the third period T3. When the fifth transistor M5 is turned on, the high voltage is supplied to the first electrode of the first transistor M1. In response to the voltage stored in the storage capacitor Cst, the first transistor M1 controls the amount of current flowing from the high voltage Vhigh to the second power supply ELVSS through the organic light emitting diode (OLED).

Figure 9:
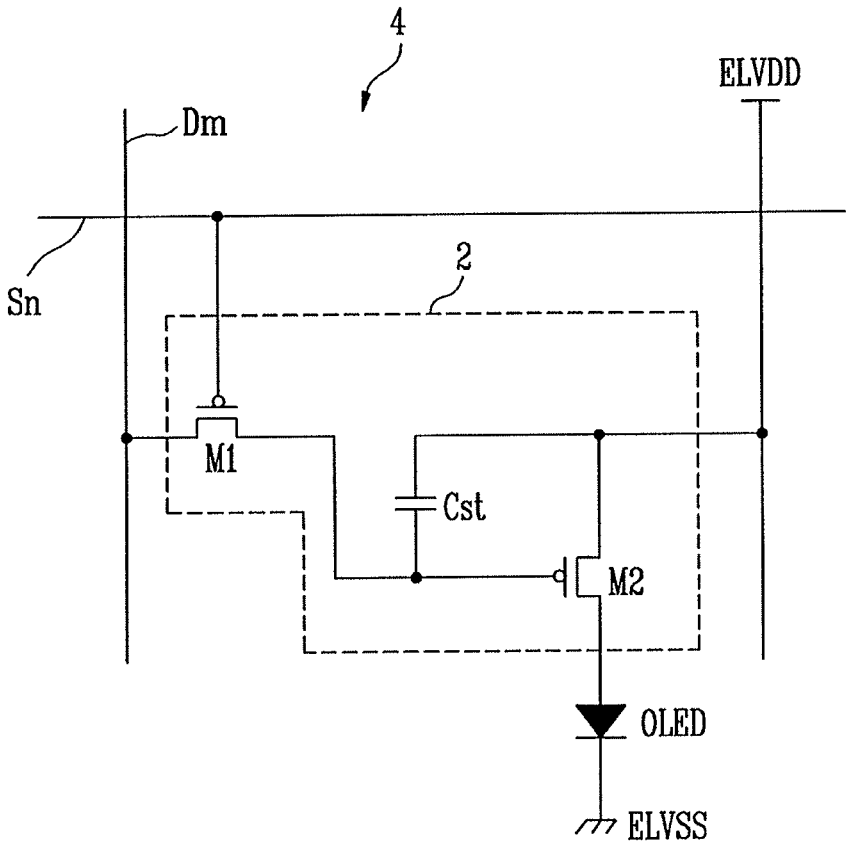
FIG. 9 is a circuit diagram illustrating a pixel of the conventional art.

FIG. 9 is a circuit diagram illustrating a pixel of an organic light emitting display device of the conventional art.

Referring to FIG. 9, a pixel 4 of an organic light emitting display device of the conventional art includes: an organic light emitting diode (OLED) and a pixel circuit 2 connected with a data line Dm and a scan line Sn. The pixel circuit 2 controls the organic light emitting diode (OLED).

The anode electrode of the organic light emitting diode (OLED) of the conventional art is connected to the pixel circuit 2. The cathode electrode is connected to a second power supply ELVSS. The organic light emitting diode (OLED) produces light with predetermined luminance in response to the current supplied from the pixel circuit 2.

In response to a data signal supplied to the data line Dm, when a scan signal is supplied to the scan line Sn, the pixel circuit 2 of the conventional art controls the amount of current supplied to the organic light emitting diode (OLED). For this configuration, the pixel circuit 2 includes: a second transistor M2 connected between a first power supply ELVDD and the organic light emitting diode (OLED), a first transistor M1 connected between the second transistor M2, the data line Dm, the scan line Sn, and a storage capacitor Cst connected between a gate electrode and a first electrode of the second transistor M2.

A gate electrode of the first transistor M1 of the conventional art is connected to the scan line Sn and a first electrode is connected to the data line Dm. A second electrode of the first transistor M1 is connected to one terminal of the storage capacitor Cst. In this configuration, the first electrode is set as any one of a source electrode and a drain electrode. The second electrode is set as the other electrode different from the first electrode. For example, when the first electrode is set as the source electrode, the second electrode is set as the drain electrode. The first transistor M1, connected to the scan line Sn and the data line Dm, is turned on and supplies a data signal. When a scan signal is supplied through the scan line Sn, the data signal is supplied, through the data line Dm, to the storage capacitor Cst. In this operation, the storage capacitor Cst is charged with a voltage corresponding to the data signal.

The gate electrode of the second transistor M2 of the conventional art is connected to one terminal of the storage capacitor Cst. The first electrode is connected to the first power supply ELVDD and the other terminal of the storage capacitor Cst. The second electrode of the second transistor M2 is connected to the anode electrode of the organic light emitting diode (OLED). The second transistor M2 controls the amount of current flowing from the first power supply ELVDD to the second power supply ELVSS through the organic light emitting diode (OLED), in response to the voltage value stored in the storage capacitor Cst. In the configuration, the organic light emitting diode (OLED) produces light corresponding to the amount of current supplied from the second transistor M2.

However, the pixel 4 of the organic light emitting display device of the conventional art cannot display an image with uniform luminance. In other words, due to process variation, the second transistors M2 (driving transistors) in the pixels 4 have different threshold voltages for each pixel 4. As the threshold voltages of the driving transistors are different, even if data signals corresponding to the same gradation are supplied to the pixels 4, light with different luminance is generated by the difference in the threshold voltage of the driving transistors.

In order to overcome the problems of the conventional art, a structure has a transistor in each pixel 4. The transistor in each pixel 4 has been proposed to compensate the threshold voltage of the driving transistor. A structure using six transistors and one capacitor for each pixel 4 to compensate the threshold voltage of a driving transistor has been disclosed (Korean Patent Publication No. 2007-0083072). However, the six transistors included in the pixel 4 create complications. With the six transistors included in the pixel 4, the possibility of malfunction is increased. In addition, the yield is correspondingly decreased.

Therefore, the present embodiments may provide a pixel having a simple structure while compensating for the threshold voltage of a driving transistor. The present embodiments may also include an organic light emitting display device using the pixel.

According to a pixel and an organic light emitting display device of the present embodiments, using a relatively simple pixel circuit, it is possible to compensate the threshold voltage of a driving transistor and voltage drop of a first power. Thus, the image will be displayed with desired luminance. According to the present embodiments, it is possible to compensate the threshold voltage of the driving transistor for a long time. According to the present embodiments, there is no problem of non-uniformity luminance. There is no problem of non-uniformity luminance because a bias voltage is applied to the driving transistor for an initializing period.

Exemplary embodiments of the inventive concept have been disclosed herein, and although specific terms are employed, they are used and are to be interpreted in a generic and descriptive sense only and not for purposes of limitation. Accordingly, it will be understood by those of ordinary skill in the art that various changes in form and details may be made without departing from the spirit and scope of the inventive concept as set forth in the following claims.

What is claimed is:

1. A pixel, comprising:

an organic light emitting diode;

a first transistor including a first electrode and a gate electrode, the first electrode directly connected with an anode electrode of the organic light emitting diode, the gate electrode connected to a first node, the first transistor to control an amount of current supplied to the organic light emitting diode;

a second transistor connected between a corresponding data line and a second node, the second transistor turned on by a scan signal supplied to a corresponding scan line;

a third transistor connected between the gate electrode of the first transistor and the first electrode of the first transistor, the third transistor having a turn-on time partially overlapping a turn-on time of the second transistor;

a fourth transistor connected between the second node and a corresponding power line receiving a first power, the fourth transistor having a turn-on time not overlapping the turn-on time of the second transistor; and a first capacitor connected between the gate electrode of the first transistor and the second node, wherein the third transistor includes a gate electrode connected to a corresponding compensation control line to which a control signal is supplied, the control signal being different from the scan signal supplied to the corresponding scan line.

2. The pixel as claimed in claim 1, wherein:

the first transistor further includes a second electrode, and the pixel further includes a fifth transistor connected between the second node and the second electrode of the first transistor, the fifth transistor turned on and off simultaneously with the fourth transistor.

3. The pixel as claimed in claim 1, further comprising:

a fifth transistor connected between the first electrode of the first transistor and the third transistor, the fifth transistor turned on and off simultaneously with the fourth transistor.

4. The pixel as claimed in claim 1, further comprising:

a second capacitor connected between the anode electrode of the organic light emitting diode and a fixed power supply.

5. An organic light emitting display device, comprising:

a plurality of pixels connected with a plurality of scan lines, a plurality of compensation control lines, a plurality of emission control lines, a plurality of power lines, and a plurality of data lines, respectively, each of the plurality of pixels being same as the pixel as claimed in claim 1, each of the plurality of scan lines being same as the corresponding scan line as claimed in claim 1, each of the plurality of data lines being same as the corresponding data line as claimed in claim 1, each of the plurality of power lines being same as the corresponding power line as claimed in claim 1;

a scan driver driving the plurality of scan lines, the plurality of emission control lines, and the plurality of compensation control lines;

a first power driver sequentially supplying the first power to the plurality of power lines, the first power selected from an initial voltage, a reference voltage, higher than the initial voltage, and a final voltage, higher than the reference voltage; and a data driver supplying data signals to the plurality of data lines.

6. The organic light emitting display device as claimed in claim 5, wherein:

the scan driver supplies the scan signal to an i-th scan line of the plurality of scan lines, when the final voltage is supplied to an i-th power line of the plurality of power lines (i is a natural number not including zero).

7. The organic light emitting display device as claimed in claim 6, wherein:

the scan driver supplies an emission control signal to an i-th emission control line of the plurality of emission control lines to overlap the scan signal supplied to the i-th scan line.

8. The organic light emitting display device as claimed in claim 5, wherein:

the initial voltage is set to a voltage where the pixels are in a non-emission state.

9. The organic light emitting display device as claimed in claim 5, further comprising:

a fifth transistor connected between the first electrode of the first transistor and the third transistor, the fifth transistor turned off when an emission control signal is supplied to an i-th emission control line.

10. The organic light emitting display device as claimed in claim 5, each of the plurality of pixels further comprising:

a capacitor connected between the anode electrode of the organic light emitting diode and a fixed power supply.

* * * * *